US006978831B2

(12) United States Patent
Nguyen

(10) Patent No.: US 6,978,831 B2
(45) Date of Patent: Dec. 27, 2005

(54) SYSTEM AND METHOD FOR SENSING DATA IN A WELL DURING FRACTURING

(75) Inventor: Philip D. Nguyen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 149 days.

(21) Appl. No.: 10/664,100

(22) Filed: Sep. 17, 2003

(65) Prior Publication Data

US 2005/0056418 A1 Mar. 17, 2005

(51) Int. Cl.[7] ..... E21B 47/00; E21B 43/26

(52) U.S. Cl. ..... 166/250.01; 166/250.1; 166/66

(58) Field of Search ..... 166/250.01, 250.07, 166/250.1, 308.1, 66

(56) References Cited

U.S. PATENT DOCUMENTS

| | | | | |
|---|---|---|---|---|
| 4,866,607 A | | 9/1989 | Anderson et al. | |
| 4,999,817 A | | 3/1991 | Zimmer | |
| 5,236,048 A | | 8/1993 | Skinner et al. | |
| 5,293,937 A | | 3/1994 | Schultz et al. | |
| 6,065,538 A | * | 5/2000 | Reimers et al. | 166/250.01 |
| 6,131,658 A | | 10/2000 | Minear | |
| 6,229,453 B1 | | 5/2001 | Gardner et al. | |
| 6,233,746 B1 | | 5/2001 | Skinner | |
| 6,310,559 B1 | | 10/2001 | Laborde et al. | |
| 6,554,064 B1 | * | 4/2003 | Restarick et al. | 166/250.01 |
| 2001/0013410 A1 | | 8/2001 | Beck et al. | |
| 2001/0013411 A1 | | 8/2001 | Beck et al. | |
| 2001/0042617 A1 | | 11/2001 | Beck et al. | |
| 2001/0043146 A1 | | 11/2001 | Beck et al. | |
| 2004/0045705 A1 | * | 3/2004 | Gardner et al. | 166/250.01 |
| 2005/0017723 A1 | * | 1/2005 | Entov et al. | 324/346 |
| 2005/0045329 A1 | * | 3/2005 | Wetzel et al. | 166/278 |

OTHER PUBLICATIONS

Lyle V. Lehman et al., "Vibrating System and Method For Use In Sand Control and Formation Stimulation In Oil And Gas Recovery Operations," filed Aug. 28, 2003 U.S. Appl. No. 10/650,186.

* cited by examiner

*Primary Examiner*—William Neuder
(74) *Attorney, Agent, or Firm*—John W. Wustenberg; Haynes & Boone LLP

(57) ABSTRACT

A system and method for sensing and recovering data in a well, according to which one or more sensors are located in an area of the well for sensing data associated with the well and transmitting corresponding signals. A tool is lowered into the area and a receiver mounted on the tool is adapted to receive the signals and transmit the signals to the ground surface.

20 Claims, 2 Drawing Sheets

SYSTEM AND METHOD FOR SENSING DATA IN A WELL DURING FRACTURING

BACKGROUND

The availability of downhole data from a well that penetrates a subterranean formation for the purpose of recovering oil and/or gas, is essential, especially when treating the subterranean formation such as during a fracturing operation. For example, formation pressure, fracture temperature, fluid properties, fracture height, and other similar downhole data should be available in connection with the fracturing operation to help optimize the treatment design, maximize potential well production, and to promote safety during the operation. Moreover, if this data could be available on a "real time" basis, such as during the fracturing operation, it would allow the fracturing engineer to make appropriate decisions concerning vital parameters, such as pump rate, proppant concentration, fluid viscosity, etc., at a much earlier time. In this manner, premature screenout can be prevented, optimum fracture design can be obtained and the safety aspect of fracturing stimulation can be promoted. Also, the availability of real time downhole data would be desirable to enable precision control of the fracturing operation so that it can be carried out at its maximum efficiency.

Therefore what is needed is a system and method for well fracturing that enables the acquisition of various downhole data parameters from the wellbore and the fractures while fracturing is in progress, or soon after the fracturing operation.

DETAILED DESCRIPTION

Figure 1:
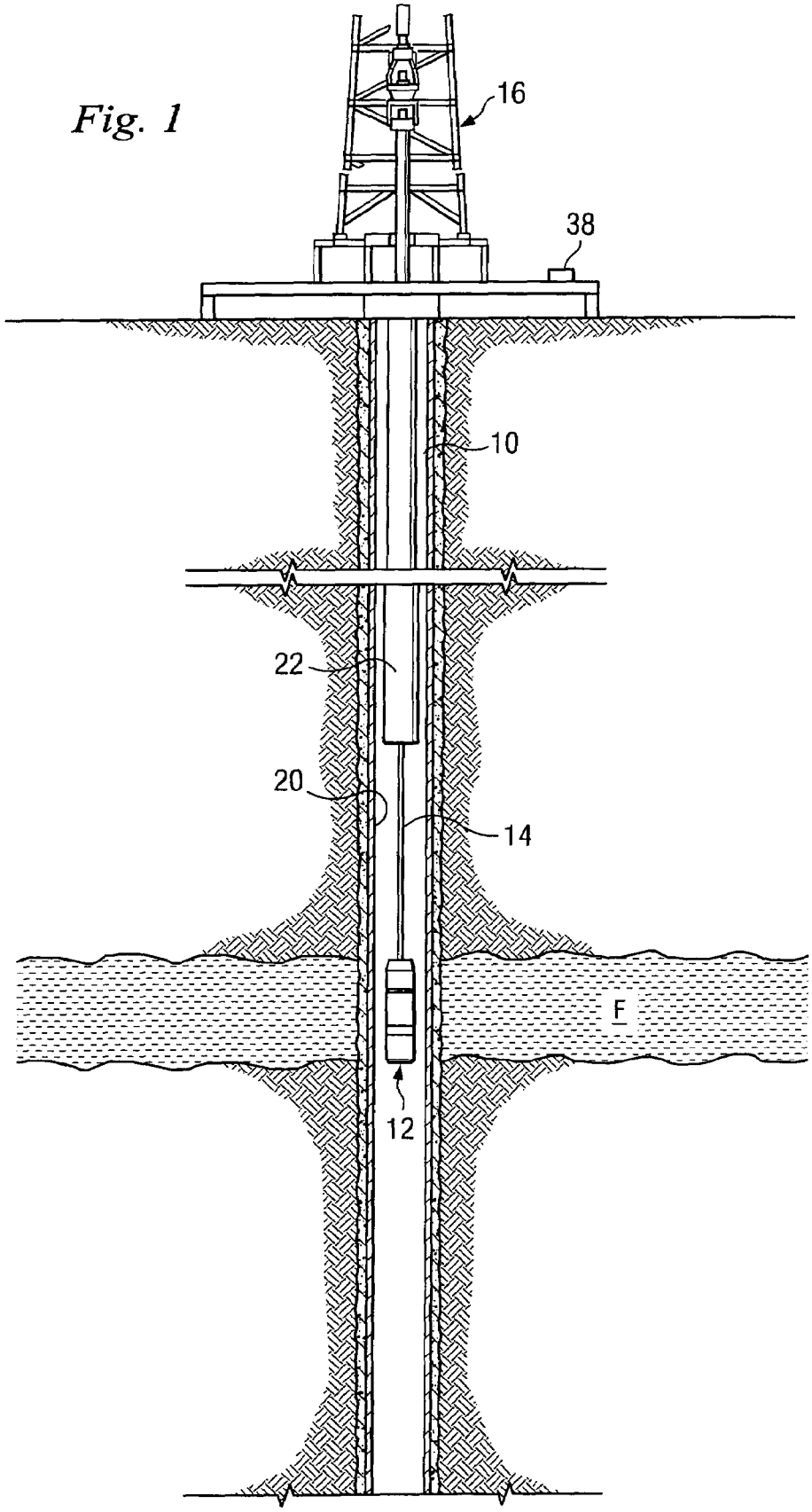
FIG. 1 is a partial diagrammatic/partial sectional view of a system for recovering oil and gas downhole in a well that employs an embodiment of the present invention.

Referring to FIG. 1, the reference numeral 10 refers to a wellbore penetrating a subterranean formation F for the purpose of recovering hydrocarbon fluids from the formation. To this end, and for the purpose of carrying out specific operations to be described, a tool 12 is lowered into the wellbore 10 to a predetermined depth by a string 14, in the form of wireline, coiled tubing, or the like, which is connected to the upper end of the tool 12. The tool 12 is shown generally in FIG. 1 and will be described in detail later.

The string 14 extends from a rig 16 that is located on the ground surface and over the wellbore 10. The rig 16 is conventional and, as such, includes, inter alia, support structure, a motor driven winch, and other associated equipment for receiving and supporting the tool 12 and lowering it to a predetermined depth in the wellbore 10 by unwinding the string 14 from a reel, or the like, provided on the rig 16. Also, stimulation, or fracturing, fluid can be introduced from the rig 16, through the wellbore 10, and into the formation F in a conventional manner, for reasons to be described.

At least a portion of the wellbore 10 can be lined with a casing 20 which is cemented in the wellbore 10 in a conventional manner and which can be perforated as necessary, consistent with typical downhole operations and with the operations described herein. Perforations may be provided though the casing 20 and the cement to permit access to the formation F as will be described. A string of production tubing 22 having a diameter greater than that of the tool 12, and less than that of the casing 20, is installed in the wellbore 10 in a conventional manner and extends from the ground surface to a predetermined depth in the casing 20.

Figure 2:
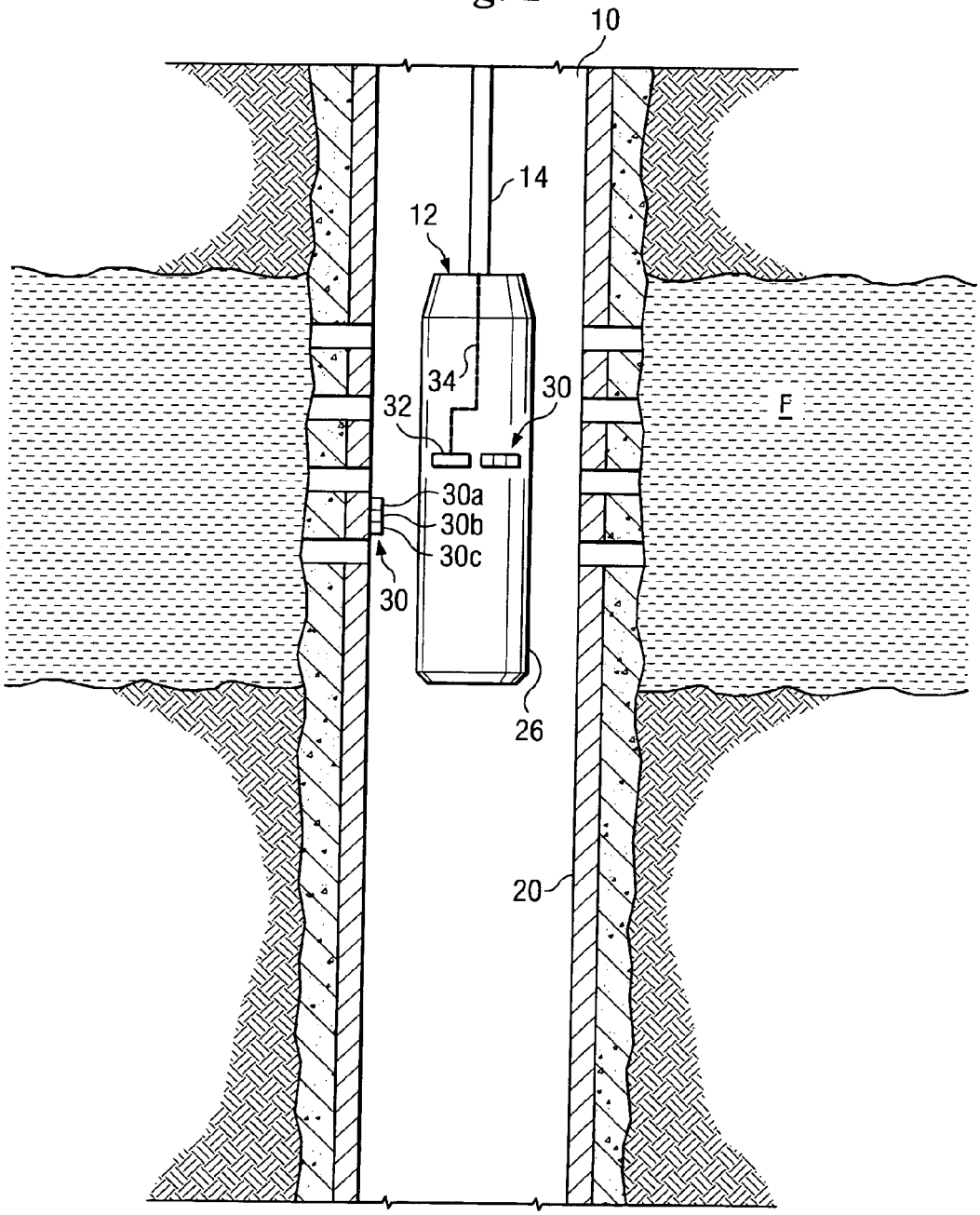
FIG. 2 is an enlarged partial view of a portion of the embodiment of FIG. 1.

As better shown in FIG. 2, the tool 12 is in the form of a cylindrical body member 26 defining an internal chamber that contains a sensor/transmitter module 30 which includes a sensor 30*a*, a microchip 30*b*, and a transmitter 30*c*. The sensor 30*a* is designed to sense one or more formation parameters associated with fracturing the formation F, including, but not limited to, pressure, temperature, resistivity, dielectric constant, rock strain, porosity, flow rate, permeability, and conductivity. The microchip 30*b* acquires the sensed information from the sensor 30*a*, stores the information, and converts the information into corresponding digital signals. The transmitter 30*c* receives the digital signals from the microchip 30*b* and transmits corresponding signals under conditions to be described.

A plurality of modules 30 can be utilized, one of which is placed on the body member 26 as discussed above, and one or more of which can be placed on the wall of the wellbore 10 and/or in the fracture in the formation F. Each module 30 is encapsulated inside a capsule of sufficient structural integrity for protection from damage. It is understood that the capsule is small enough to pass through the perforations in the casing 20 and the cement, and into a fracture in the formation F without causing bridges at the perforations or premature screen out in the wellbore 10.

A data receiver module 32 is also located in the chamber in the body member 26 and can be in the form of piezoelectric element or an acoustic vibration sensor, and includes a coil, or the like, for receiving signals under conditions to be described. The receiver module 32 is connected to a cable package 34 which includes one or more electrical conductors that extend through the tool 12 and the string 14 to the rig 16 for reasons to be described.

Although not shown in the drawings, it is understood that the above chamber in the body member 26 can also include a power supply, which can be in the form of a battery, a capacitor, a fuel cell, or the like, for powering the modules 30 and 32.

A controller 38 (FIG. 1) is located above ground surface at or near the rig 16, and is connected to the cable package 34. The controller 38 can include a computing device, such as a microprocessor, a display, and a monitoring apparatus.

In operation, the controller 38 sends an initiation signal via the receiver module 32 to the modules 30 to activate the sensors 30*a*. The sensors 30*a* function to acquire data related to one or more of the formation parameters identified above, and the microchips 30*b* receive this information from the sensors 30*a*, store the sensed information and convert it into corresponding digital signals before passing the signals to the transmitters 30*c*. The transmitters 30*c* convert the signals into a form, such as acoustic, seismic, radio frequency, or electromagnetic energy that is transmitted to the receiver module 32 which converts the signals into a format that can be transmitted, via the cable package 34, to the controller 38 for display and monitoring.

It is understood that all of this can be done during a fracturing operation in which fracturing fluid carrying a proppant is introduced into the annulus between the outer surface of the tool 12 and the inner wall of the casing 20. By monitoring the changes in the data sensed and displayed in real time, personnel would then be able to quickly and efficiently adjust downhole conditions such as proppant concentration, pump rates, fluid properties, net pressures, and other variables, to control the safety and efficiency of the fracturing operation, and to obtain optimum fracture design.

It is understood that if sand control screens and related equipment are installed in the wellbore 10, one or more of the modules 30 can be attached directly to the screen assembly.

According to the above, the sensing, converting and transmitting of the above formation parameters can enable the following to be determined:

Temperature profile of any fluid pumped into the wellbore 10 with respect to space (in wellbore 10 and inside fracture) and time Pump rates and net pressures Fracture temperature and closure pressure When actual closure stress occurs and the actual amount Degree of polymer cleanup after gel flowback Permeability, conductivity, and porosity of any proppant packs that are used in the fracturing process Production profile.

Thus, the above system and method enable the acquisition of various downhole data parameters from the wellbore 10 and the fractures while fracturing is in progress, or soon after the fracturing operation. As a result, the fracturing operation can be carried out at its maximum efficiency and premature screenout can be prevented, optimum fracture design can be obtained, and the safety aspect of fracturing stimulation can be promoted.

VARIATIONS AND ALTERNATIVES

It is understood that variations may be made in the foregoing without departing from the scope of the inventions. For example, the number of modules 30 and 32 can be varied. Also, the modules 30 can be designed to communicate or relay information between one another and with a base station. Further, the specific data that is sensed and transmitted in accordance with the foregoing can be varied. Still further, the rig 16, the casing 20, and the production tubing 22 are not essential to the embodiment described above and can be eliminated.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A system for sensing data associated with fracturing a subterranean formation penetrated by a well bore, comprising:

at least one sensor located in a fracture in the formation for sensing the data associated with the fracturing and for transmitting corresponding signals;

a tool adapted to be lowered into the well bore;

a receiver mounted on the tool and adapted to receive the signals; and means for transmitting the signals from the receiver to the ground.

2. A method of sensing data associated with fracturing a subterranean formation penetrated by a well bore, comprising the steps of:

lowering a tool into the well bore;

sensing data with a sensor located in a fracture in the formation;

transmitting signals corresponding to the sensed data;

receiving the signals corresponding to the sensed data at the tool; and transmitting signals corresponding to the received signals from the tool to the ground surface.

3. A system for sensing data associated with fracturing a subterranean formation penetrated by a well bore, comprising:

a sensor located in a fracture in the formation for sensing data associated with the fracturing and for transmitting corresponding signals;

a tool adapted to be lowered into the well bore;

means mounted on the tool and adapted to receive the signals; and means for transmitting the signals from the tool to the ground.

4. A method of sensing data associated with fracturing a subterranean formation penetrated by a well bore, comprising the steps of:

sensing data associated with the fracturing;

storing the data in the well bore;

converting the data into digital signals in the well bore;

passing the digital signals to a transmitter in the well bore;

converting the digital signals at the transmitter to analog signals;

transmitting the analog signals to a receiver located in the well bore;

converting the signals at the receiver to signals that can be transmitted to the ground surface; and transmitting the signals from the receiver to the ground surface.

5. The method of claim 4 wherein each analog signal is one of an acoustic, seismic, radio frequency, or electromagnetic signal.

6. The method of claim 4 further comprising introducing fracturing fluid into the well bore during the steps of sensing, storing, converting, passing and transmitting.

7. The method of claim 4 further comprising the step of transmitting a signal from the ground surface to the sensor to initiate the step of sensing.

8. The method of claim 4 wherein the second step of transmitting comprises connecting an electrical conductor between the receiver to a controller at the ground surface.

9. The method of claim 4 further comprising the step of lowering a tool into the well bore, and wherein the steps of sensing, storing, converting, passing and transmitting are done at the tool.

10. The method of claim 4 wherein the steps of sensing, storing, converting, passing, and the first step of transmitting are done at a casing disposed in the well bore.

11. The method of claim 10 further comprising the step of lowering a tool into the well bore, and wherein the second step of transmitting is done at the tool.

12. The method of claim 4 wherein the step of sensing is done in a fracture in the formation.

13. A system for sensing data associated with fracturing a subterranean formation penetrated by a well bore, the system comprising:

a sensor disposed in the well bore for sensing data associated with the fracturing and transmitting the data;

a microprocessor disposed in the well bore for receiving and storing the data, converting the data into digital signals, and transmitting the digital signals;

a transmitter disposed in the well bore for receiving the digital signals from the microprocessor, converting the digital signals to analog signals, and transmitting the analog signals; and a receiver disposed in the well bore for receiving the analog signals from the transmitter, converting the analog signals to transmissible signals, and transmitting the transmissible signals to the ground surface.

14. The system of claim 13 wherein each analog signal is one of an acoustic, seismic, radio frequency, or electromagnetic signal.

15. The system of claim 13 further comprising means for introducing fracturing fluid into the well bore during the sensing, storing, converting, and transmitting.

16. The system of claim 13 further comprising means for transmitting a signal from the ground surface to the sensor to initiate the step of sensing.

17. The system of claim 13 further comprising an electrical conductor for transmitting the signals from the receiver to the ground surface.

18. The system of claim 13 further comprising a tool disposed in the well bore, and wherein the sensor, microprocessor, transmitter and receiver are mounted on the tool.

19. The system of claim 13 wherein the sensor, the microprocessor, and the transmitter are mounted on a casing in the well bore.

20. The system of claim 19 further comprising a tool disposed in the well bore, and wherein the receiver is mounted on the tool.

* * * * *